US007934270B2

(12) United States Patent
Kishino

(10) Patent No.: US 7,934,270 B2
(45) Date of Patent: May 3, 2011

(54) COLD-WEATHER GLOVE

(75) Inventor: Etsuo Kishino, Minami-Uonuma-gun (JP)

(73) Assignee: Kabushiki Kaisha Kurebu, Niigata (JP)

( * ) Notice: Subject to any disclaimer, the term of this patent is extended or adjusted under 35 U.S.C. 154(b) by 614 days.

(21) Appl. No.: 12/014,937

(22) Filed: Jan. 16, 2008

(65) Prior Publication Data

US 2009/0083897 A1 Apr. 2, 2009

(30) Foreign Application Priority Data

Sep. 28, 2007 (JP) ..... 2007-255407

(51) Int. Cl.
*A41D 19/00* (2006.01)

(52) U.S. Cl. ..... 2/160; 2/162

(58) Field of Classification Search ..... 2/160, 162, 2/164, 170

See application file for complete search history.

(56) References Cited

U.S. PATENT DOCUMENTS

| | | | | |
|---|---|---|---|---|
| 3,214,771 | A * | 11/1965 | Treiber | 2/270 |
| 7,191,472 | B1 * | 3/2007 | Kishino | 2/160 |
| 2009/0083897 | A1 * | 4/2009 | Kishino | 2/160 |

FOREIGN PATENT DOCUMENTS

| | | |
|---|---|---|
| JP | 53-77017 | 6/1978 |
| JP | 60-155566 U | 10/1985 |
| JP | 9-228117 A | 9/1997 |
| JP | 3836817 B2 | 8/2006 |

OTHER PUBLICATIONS

Japanese Office Action dated Sep. 24, 2009 (2 pages).

* cited by examiner

*Primary Examiner* — Katherine Moran
(74) *Attorney, Agent, or Firm* — Sughrue Mion, PLLC

(57) ABSTRACT

To make it easier to remove and insert a covering part via an accommodation part in a cold-weather glove in which the accommodation part is provided to a glove body and in which the covering body, which imparts cold weather protection, is connected to the accommodation part. A side part of the hem part (10) of the glove body (1) is divided, the divided end part of the hem part (10) on the side of the back-of-the-hand part extends towards a side of the glove body (1), and the laterally extending part (11) can be superposed in alignment along the palm part-side of the hem part (10). Releasable holding means (5) is provided for holding the laterally extending part (11) in a superposed state along the palm part-side of the hem part (10). The access opening 4 extends to the laterally extending part (11), and the opening width of the communicating opening part (4A) is increased when the access opening (4) is opened. The access opening (4) is configured so as to be capable of being opened and closed via a fastener (40).

10 Claims, 5 Drawing Sheets

COLD-WEATHER GLOVE

BACKGROUND OF THE INVENTION

1. Field of the Invention

The present invention relates to a cold-weather glove for skiing, snowboarding, or mountain climbing.

2. Description of the Related Art

The applicant has obtained Japanese Patent No. 3836817 for a cold-weather glove relating to the above description.

The following is a brief description of Japanese Patent No. 3836817. An accommodation part is provided to a back-of-the-hand portion of a glove body. A mitten-shaped covering body that can cover substantially the entirety of the glove body from the finger tips to the hem part is removably accommodated and disposed inside the accommodation part. The covering body is also inseparably provided to the glove body or the accommodation part in a connected state.

According to the configuration in Japanese Patent No. 3836817, the covering body can be unobtrusively accommodated inside the accommodation part. Therefore, a separate over-mitten, which is a conventional cold-weather protective item, does not need to be carried along with the cold-weather glove. Since the accommodation part is provided to the back-of-the-hand portion of the glove body, the palm portion of the glove body exhibits the same usability and functionality as a conventional cold-weather glove. Furthermore, a simple operation is carried out, wherein the covering body is merely removed from the accommodation part, and used to cover substantially the entire glove body from the fingertips to the hem part, whereby substantially the entirety of the glove body can be endowed with cold-weather protection. When this operation is performed, the covering part will connected to the glove body or the accommodation part, thereby resulting in a highly practical solution in that the covering body will not fall or be lost.

SUMMARY OF THE INVENTION

The present invention, which relates to an application for an improvement that aims to enhance the practical applicability of Japanese Patent No. 3836817, provides a cold-weather glove exhibiting a further improvement in regard to the ease with which the covering body is removed from or inserted into the accommodation part.

The main points of the present invention will be described with reference to the attached drawings.

The present invention relates to a cold-weather glove in which an accommodation part 2 is provided to a back-of-the-hand portion of a glove body 1. A covering body 3 that can cover substantially the entirety of the glove body 1 from the fingertips to the hem part 10 is accommodated and disposed inside the accommodation part 2. An access opening 4 that is capable of being opened and closed is provided to the hem part 10 in the back-of-the-hand portion of the glove body 1, the access opening having an opening width in the peripheral direction of the wrist along the hemline 10A of the hem part 10, and connecting an outer part of the hem part 10 to an inner part of the accommodation part 2. The covering part 3 can be withdrawn from or inserted through the accommodation part 2 via a communicating opening part 4A within the access opening 4. The covering part 3 is inseparably provided to the glove body 1 or the accommodation part 2 in a connected state. In this glove, a side part of the hem part 10 of the glove body 1 is divided, the divided end part of the hem part 10 on the side of the back-of-the-hand part extends towards a side of the glove body 1, and the laterally extending part 11 can be superposed in alignment along the palm part-side of the hem part 10. Releasable holding means 5 is provided for holding the laterally extending part 11 in a superposed state along the palm part-side of the hem part 10. The laterally extending part 11 can be opened toward the side of the hem part 10 by releasing the holding means 5. The access opening 4 provided to the hem part 10 of the back-of-the-hand part of the glove body 1 extends to the laterally extending part 11, the laterally extending part 11 is opened laterally with regard to the hem part 10, and the opening width of the communicating opening part 4A is increased when the access opening 4 is opened.

The present invention further relates to the cold weather glove according to the first aspect, wherein the laterally extending part 11, which is in the shape of a band, is provided so that the divided end of the hem part 10 on the side of the back-of-the-hand part extends in a band shape laterally with regard to the glove body 1. When the laterally extending part 1 is superposed in alignment along the palm part-side of the hem part 10, the access opening 4 extends to an area that is on the palm part side.

The present invention also relates to the cold-weather glove according to the first or second aspect, wherein the access opening 4 is configured so as to be capable of being opened and closed via a fastener 40.

The present invention also relates to the cold-weather glove according to the first or second aspect, wherein the access opening 4 is provided to a surface of the hem part 10 in the back-of-the-hand portion of the glove body 1. The access opening 4 extends to a surface of the laterally extending part 11. A fastener 40 is provided to the access opening 4, wherein the fastener 40 can be opened and closed by moving an operating body 40A.

The present invention also relates to the cold-weather glove according to the third aspect, wherein the access opening 4 is provided to a surface of the hem part 10 in the back-of-the-hand portion of the glove body 1. The access opening 4 extends to a surface of the laterally extending part 11. A fastener 40 is provided to the access opening 4, wherein the fastener 40 can be opened and closed by moving an operating body 40A.

Since the present invention is configured as described above, the operation and effects exhibited in Japanese Patent No. 3836817 are the same, and releasing the holding means and opening the extending part toward the side of the hem part makes it possible to open the communicating opening part, which is the access opening for the covering part, to a width that is greater than that of the back-of-the-hand portion. Therefore, it becomes very simple to carry out the operation of removing or inserting the covering body via the widely opened communicating opening part. Furthermore, opening the laterally extending part makes it possible for the palm-part-side hem part disposed along the wrist to be separated from the wrist. Therefore, the communicating hole of the access opening provided to the hem part can be widened not only away from the wrist, but also towards the wrist. This makes it possible to widely open the communicating opening even in a state where the glove body is worn on the wrist. The operation of removing or inserting the covering body via the communicating opening can be carried out very easily. The cold-weather glove accordingly has extremely high practical applicability.

According to the present invention of the second aspect, the band-shaped laterally extending part is superposed in alignment along the palm part-side of the hem part or opened toward the side of the hem part so as to facilitate the operation. In addition, the access opening can be reliably configured so that the opening of the communicating opening part widens along the length direction of the laterally extending part. Therefore, an even more practically applicable cold-weather glove is obtained.

In the third aspect, the access opening can be readily opened and closed using a fastener. The operation of removing or inserting the covering body is therefore further facilitated, and a cold-weather glove that is extremely practically applicable is obtained.

In the fourth and fifth aspects, the fastener (access opening) can be opened and closed merely by moving the operating body, and the operation of removing and inserting the covering body is therefore further improved. Furthermore, since the fastener is provided to the surface of the hem part and the surface of the laterally extending part, the operating body, which is exposed to the surface, can be readily manipulated without a hand having to be inserted inside the hem part. A cold-weather glove having excellent practical applicability is therefore obtained, wherein the opening and closing operation is even further improved.

DESCRIPTION OF THE PREFERRED EMBODIMENTS

Figure 1:
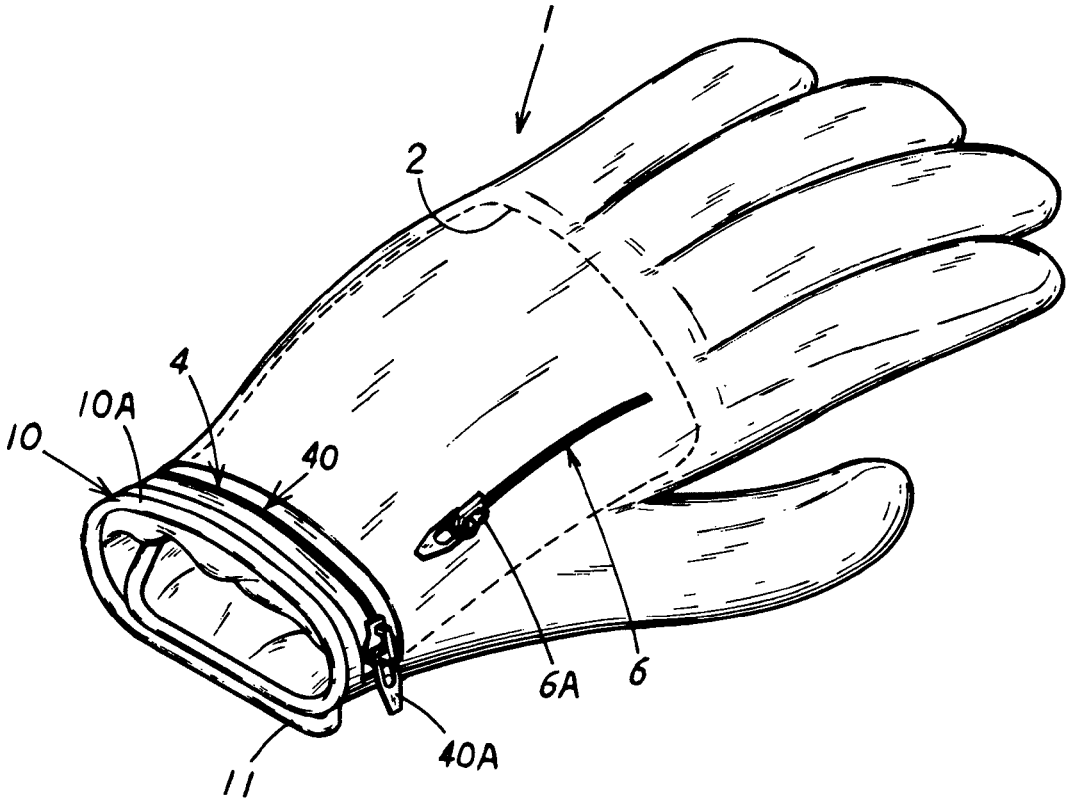
FIG. 1 is a front view showing the present example.

The following is a brief description of the preferred embodiments of the present invention (showing how to implement the invention), with reference being made to the accompanying drawings, which show the operation of the present invention.

A covering body 3 can normally be unobtrusively accommodated inside an accommodation part 2. Therefore, a separate over-mitten, which is a conventional cold-weather protective item that is worn over a glove, does not need to be carried along with the cold-weather glove.

The accommodation part 2 is provided to the back-of-the-hand portion of a glove body 1. Therefore, even when the covering body 3 is in an accommodated state, the palm portion will exhibit the same usability and functionality as a conventional cold-weather glove, without being adversely affected.

When the finger tips or other parts of the hand are cold, the covering body 3 is removed from the accommodation part 2 via a communicating opening 4A by opening an access opening 4. The covering body 3 is placed over substantially the entirety of the glove body 1 from the fingertips to a hem part 10, whereby substantially the entirety of the glove body 1 can be imparted with better cold weather protection.

In this case, the covering body 3, which is connected to the hem part 10 of the glove body 1 or the accommodation part 2, will not get lost even if dropped in the unlikely event that the covering body separates from the glove body 1.

When the covering body 3 is to be removed from the accommodation part 2, the holding means 5 is released, a laterally extending part 11 is opened toward the side of the hem part 10, and an access opening 4 that extends to the laterally extending part 11 is completely opened. As a result, the communicating opening part 4A will open wider than the lateral width in the back-of-the-hand portion of the glove body 1, and the covering body 3 can be readily removed from the communicating opening part 4A that has been opened at least as wide as the width of the glove body 1.

When the laterally extending part 11 is opened toward the side of the hem part 10, an operation can be carried out in which the shell-part-side hem part 10, which is curved so as to be disposed in alignment along the wrist T, is separated (lifted up) away from the periphery of a wrist T (back-of-the-hand portion). The access opening 4 provided to the shell-part-side hem part 10 is opened in a state in which the shell-part-side hem part 10 has been separated from the wrist T. As a result, and as shown in FIG. 6, the communicating opening part 4A can be widened inward toward the wrist T as well as outward from the wrist T, even while the glove body 1 is being worn, as a result of the hem line 10A in the back-of-the-hand portion having been separated from the wrist T. Therefore, the communicating opening part 4A of the access opening 4 can be opened much wider than in a case where the hem part cannot be separated away from the wrist T, as in the state shown in FIG. 5. The covering body 3 can be readily removed from the wide-opening communicating opening part 4A.

Similarly, regardless of whether or not the glove body 1 is being worn on the hand, the covering body 3 can be readily accommodated in the accommodation part 2 via the communicating opening part 4A, which can be opened wide by opening the laterally extending part 11.

EXAMPLES

Specific examples of the present invention will be described according to the drawings.

The present example is used in a five finger-type glove (cold-weather glove) that can be used for skiing, snowboarding, or mountain climbing; and has a hem part 10 that extends in a cylindrical shape from the wrist portion of the glove body 1 toward the arm.

In the present example, the accommodation part 2 is provided from the back-of-the-hand portion of the glove body 1 to the hem part 10. A mitten-shaped covering body 3 able to cover substantially the entirety of the glove body 1 from the fingertips to the hem part 10 is removably accommodated and disposed inside the accommodation part 2. The covering body 3 is also inseparably provided to the glove body 1 or the accommodation part 2 in a connected state.

Specifically, a configuration is adopted in which the outer part and the inner part in the back-of-the-hand portion of the glove body 1 are not sewn together, so that a gap can be formed between the outer part and the inner part. This gap formed between the outer part and the inner part is used as the accommodation part 2. Specifically, the accommodation part 2 is incorporated into the back-of-the-hand portion of the glove body 1.

The accommodation part 2 is formed in substantially the entire region from the back-of-the-hand portion of the glove body 1 to the hem part 10. A closeable access opening 4 is provided to the surface of the hem part 10 of the glove body 1 on the side of the back-of-the-hand part, and connects the outer part of the glove body 1 and the inner part of the accommodation part 2. The covering body 3 can be removed from and inserted into the accommodation part 2 via the communicating opening 4A used to open the access opening 4.

As shown in FIG. 1, the access opening 4 in the present example is located in the vicinity of the hem line 10A of the hem part 10 on the back-of-the-hand part-side, and is formed in a horizontal line that extends along the hem line 10A in the peripheral direction of the wrist T. This horizontal-line-shaped access opening 4 is configured so as to open and close via a fastener 40.

The fastener 40 is a sliding fastener 40 (zipper) that can be opened and closed by laterally moving an operating body 40A. The opening and closing operation can be readily carried out by moving the operating body 40A.

Other items can be accommodated together with the covering body 3 in the accommodation part 2, or a pocket warmer or another heat-retaining article can be accommodated in the accommodation part in order to improve heat-retention. A fastener other than a slide fastener (e.g., a surface fastener) may also be used as the fastener 40. The access opening 4 may also be provided with separate opening/closing means employing buttons or hooks.

Figure 3:
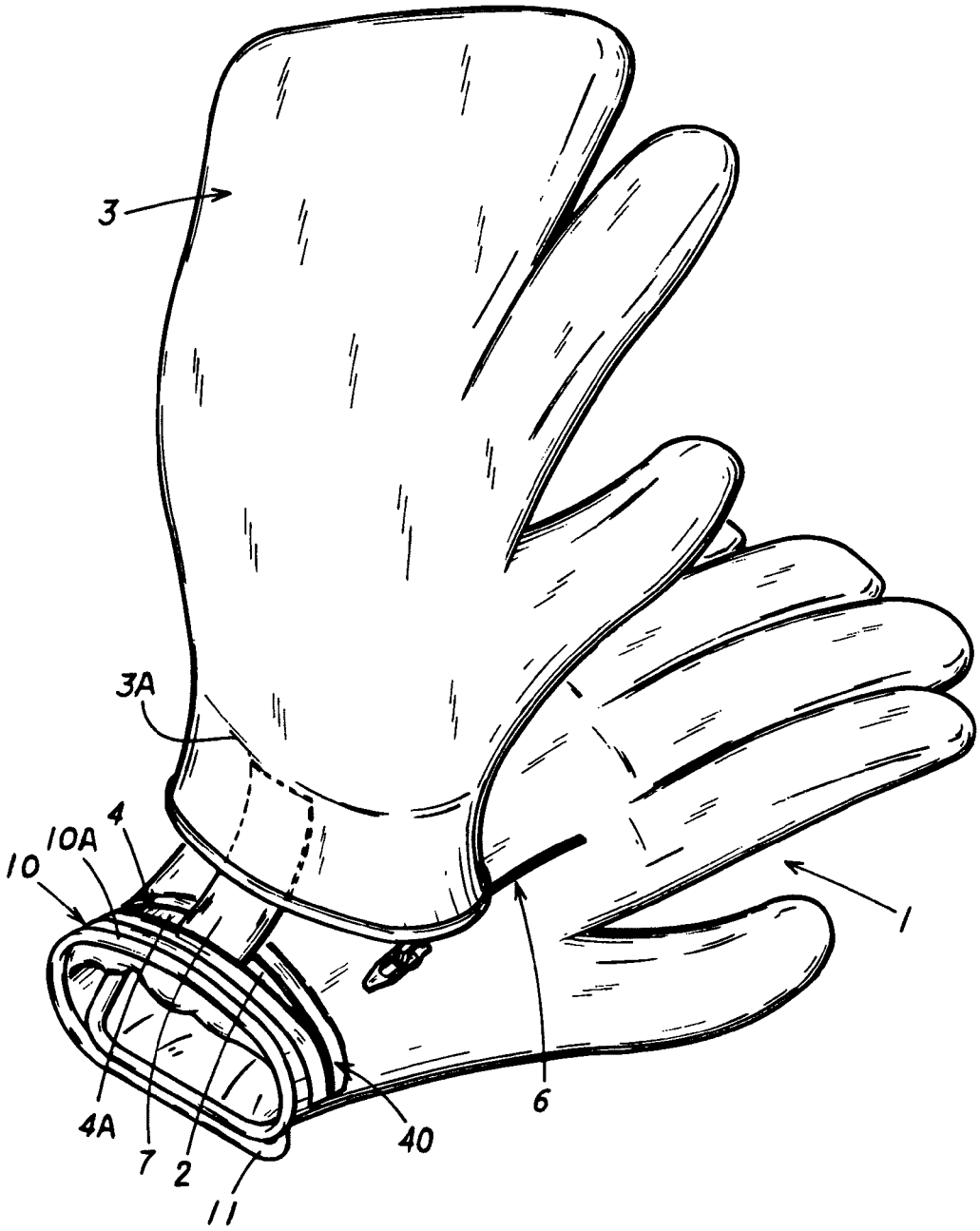
FIG. 3 is a side view showing a state in which the covering body is removed from the accommodation part of the present example.
Figure 4:
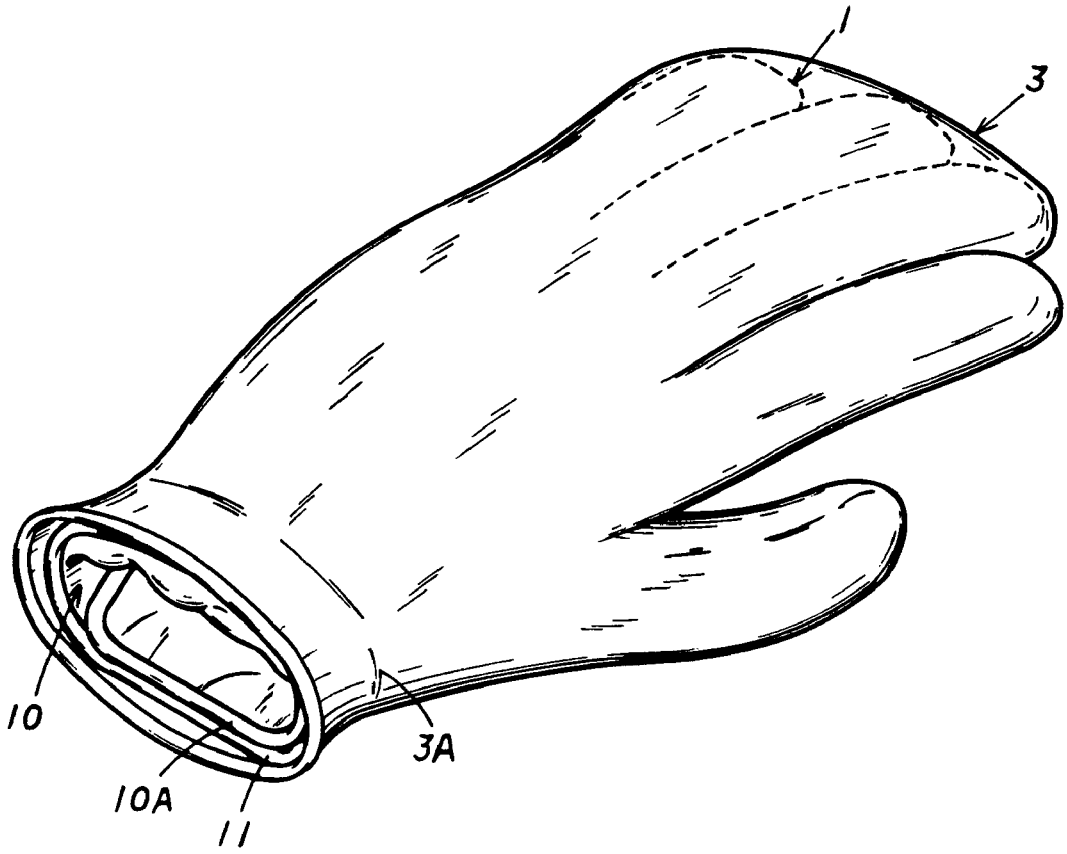
FIG. 4 is a front view showing a state in which the covering body covers the glove body of the present example.

As shown in FIGS. 3 and 4, the covering body 3 of the present example completely encloses the five fingers, and is formed having a three finger-type mitten shape that covers substantially the entirety of the glove body 1 up to the hem part 10. Specifically, the covering body 3 has the same structure as a cold-weather article known as an over mitten, which is worn over a glove in order to improve cold weather protection.

Rubber or another elastic material is sewn into the wrist portion of the covering body 3 to impart elasticity thereto. When the covering body 3 is to cover the glove body 1, the elastic part 3A in the wrist portion of the covering body 3 is fitted to the wrist portion of the glove body 1, a satisfactory fit is maintained, and the covering body 3 does not readily detach. It is also possible to provide a tightening band or another such tightening implement to the wrist portion of the covering body 3 to communicate a feeling of attachment. However, a structure provided with the elastic part 3A, as in the present example, affords greater utility when the covering body is accommodated in the accommodation part 2 since less bulkiness is reduced (the covering body is readily accommodated).

Figure 2:
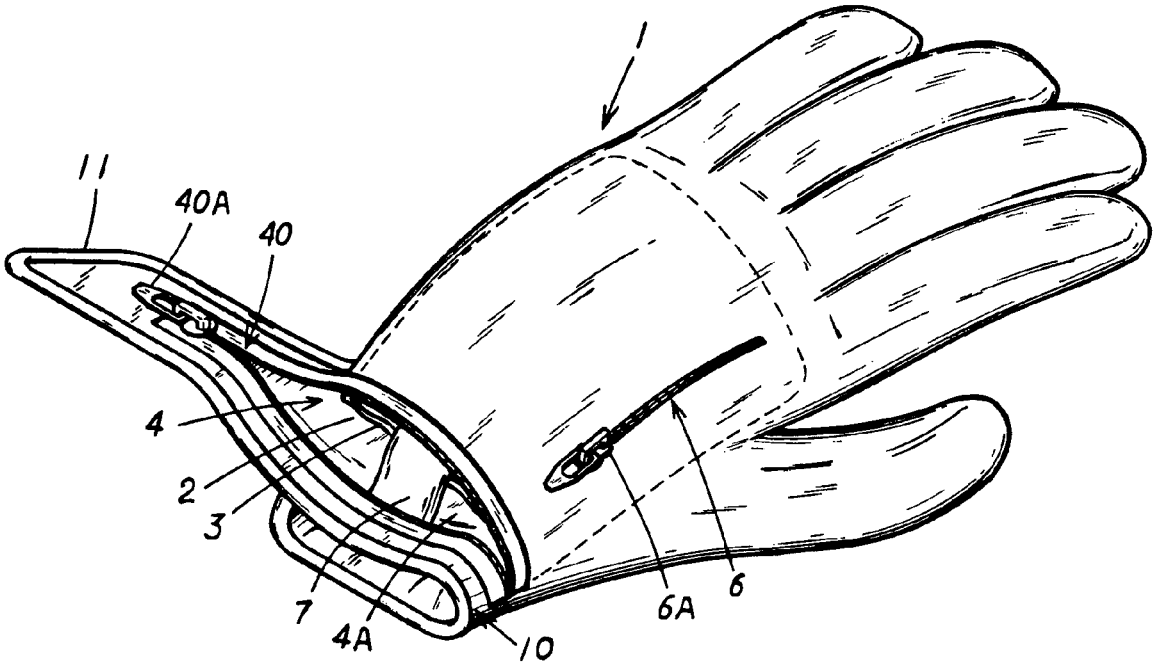
FIG. 2 is a perspective view showing a state in which the laterally extending part of the present example is opened toward the side of the hem part, and the access opening is opened.

The covering body 3 is connected to the accommodation part 2 of the glove body 1 in the following configuration (FIGS. 2 and 3). One end of a band-shaped connecting part 7 is sewn to the hem line of the covering body 3 on the side of back-of-the-hand part, and the other end of the connecting part 7 is sewn in the vicinity of the communicating opening part 4A inside the accommodation part 2.

The connecting part 7, which connects the accommodation part 2 and the covering body 3, is made of an elastic material (e.g., rubber). Stretching the connecting part 7 enables the covering body 3 to readily cover the glove body 1 or be readily removed from the glove body.

For example, the covering body 3 is made of an elastic material (fabric), and the hem line of the elastic covering body 3 is sewn in the vicinity of the communicating opening part 4A inside the accommodation part 2. The covering body 3 is thereby connected to the accommodation part 2 of the glove body 1. In an alternative configuration, the elasticity of the covering body 3 itself allows the covering body 3 to be taken on and off the glove body 1 with the same ease as in the configuration in which the covering body is connected by the elastic connecting part 7 described above.

In the present example, the side part of the hem part 10 of the glove body 1 is divided, and the divided end part of the hem part 10 on the side of the back-of-the-hand part extends in the lateral direction of the glove body 1. The laterally extending part 11 is superposed in alignment along the palm part-side of the hem part 10. As a result, the hem part 10 can be disposed along the periphery of the wrist T entering the glove body 1. The laterally extending part 11 can also be separated from the palm part of the hem part 10, and opened toward the side of the hem part 10. The laterally extending part 11 can be opened toward the side of the hem part 10 by releasing the holding means 5.

Specifically, the side part of the hem part 10 of the glove body 1 is divided in a direction orthogonal to the peripheral direction of the wrist in the hem part 10. The divided part can be used to increase the cylindrical diameter of the hem part 10.

The divided end part of the hem part 10 on the side of the back-of-the-hand part extends in a band shape (belt shape), and protrude past the band-shaped laterally extending part 11. In addition, the band-shaped laterally extending part 11 is configured having a longitudinal dimension that allows the extending end part to be superposed in alignment along the palm part-side of the hem part 10.

In the present example, the access opening 4 is formed so as to extend to the vicinity of the extending end of the laterally extending part 11. The end part of the access opening 4 reaches the palm part-side when the laterally extending part 11 is superposed along the palm part-side of the hem part 10. The width of the opening of the communicating opening part 4A when the elongated access opening 4 is opened is expanded to at least the width of the glove body 1.

The access opening 4 is provided in an exposed state with regard to the surfaces (exterior surfaces) of the laterally extending part 11 and the hem part 10 in the back-of-the-hand portion of the glove body 1.

Therefore, opening the laterally extending part 11 toward the hem part 10 makes it possible for the hem part 10 on the side of back-of-the-hand part and the access opening 4 provided to the hem part 10 on the side of the back-of-the-hand part to be separated from the wrist T inserted into the glove body 1.

Figure 5:
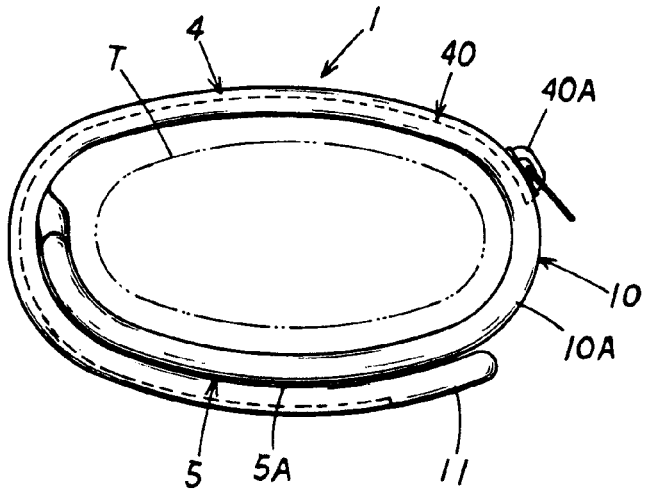
FIG. 5 is a descriptive diagram showing a state in the present example in which the laterally extending part is superposed in alignment along the palm part-side, and held in place by the holding means.
Figure 6:
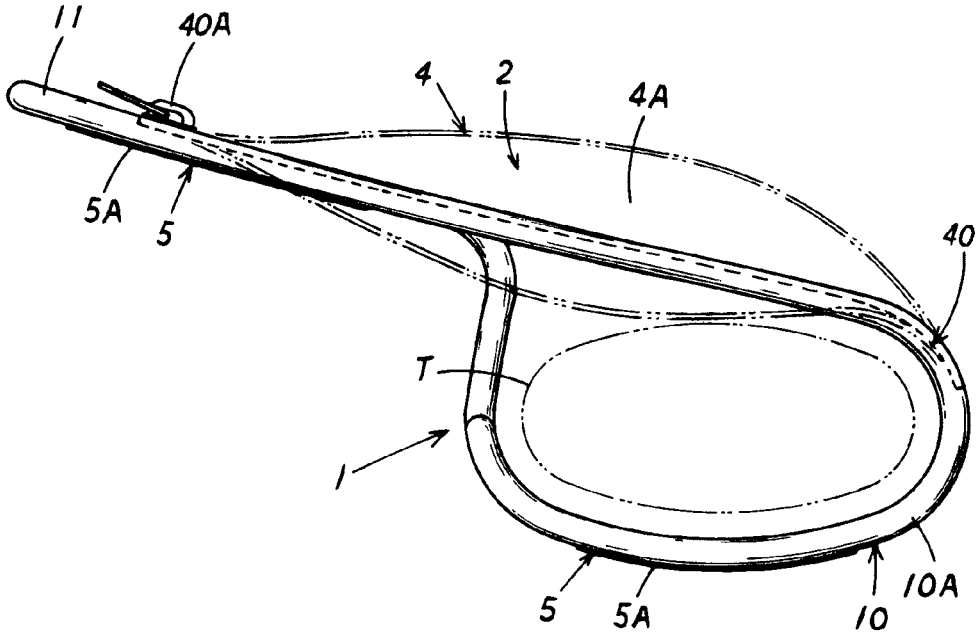
FIG. 6 is a descriptive diagram showing a state in the present example in which the holding means is released and the laterally extending part is opened toward the side of the hem part.

Consequently, opening the laterally extending part 11 when the covering body 3 is to be removed from the accommodation part 2 makes it possible for the hem part 10, which is disposed on the side of the back-of-the-hand-part along the wrist T as shown in FIG. 5, to be separated from the wrist T as shown in FIG. 6. The separating of the hem part 10 on the side of the back-of-the-hand part from the wrist T allows the communicating opening 4A to be widened away from the wrist T, as well as toward the wrist T. Therefore, the hem part on the side of the back-of-the-hand part cannot be separated very far from the wrist, and the communicating opening part 4A in the present example can be opened much wider than in a case where the access opening 4 is provided to a conventional glove, in which the hem part remains in a curved shape along the peripheral direction of the wrist. Furthermore, the access opening 4 is formed so as to extend to the extending part of the laterally extending part 11 of the hem part 10 on the side of the back-of-the-hand part. Therefore, the opening of the communicating opening part 4A is very wide, and the covering body 3 can be readily removed from the wide-opening communicating opening part 4A, even when the glove body 1 is worn on the hand.

In the present example, holding means 5 is provided for maintaining a state in which the laterally extending part 11 is superposed in alignment along the palm part-side of the hem part 10, and the cylindrical diameter of the hem part 10 is reduced. Releasing the holding means 5 enables the laterally extending part 11 to be opened.

A detailed description of the holding means 5 shall now be provided. A surface fastener 5A is attached to the rear surface (inner surface) of the laterally extending part 11 and the surface (outer surface) of the palm part-side hem part 10. As shown in FIG. 5, the laterally extending part 11 is laid over the surface of the palm part-side hem part 10, interlocking with and being immovably attached to the surface fastener 5A. As a result, a state is maintained in which the laterally extending part 11 is superposed, and a state is also maintained in which the cylindrical diameter of the hem part 10 is reduced (the hem part 10 is disposed along the periphery of the wrist T when the glove body 1 is worn on the hand) (the fit of the hem part 10 on the wrist T is satisfactorily maintained).

In the present example, a closeable auxiliary opening/closing part 6 is disposed on the back-of-the-hand portion of the glove body 1. The auxiliary opening/closing part connects the outer part of the glove body 1 and the inner part of the accommodation part 2. The state in which the covering body 3 is accommodated inside the accommodation part 2 can be adjusted via the opened auxiliary opening/closing part 6.

Specifically, an opening part that has a vertical line shape having the opening width in the direction along the side edge part of the glove body 1 (the right side edge part when viewed from the shell side of the left hand glove body in the drawings) is formed in the back-of-the-hand portion of the glove body 1. This opening part is the auxiliary opening/closing part 6. The auxiliary opening/closing part 6 is provided with a slide fastener 6A (zipper) that can be opened and closed by vertically moving an operating body. The opening/closing part can be readily opened and closed by vertically moving the operating body. A fastener other than a slide fastener (e.g., a surface fastener) may be used as means for opening/closing the auxiliary closing/opening part 6. Other opening/closing means employing buttons or hooks may also be used.

The present invention is not limited by the present example; the specific structure of the constituent features can be designed as appropriate.

For example, a five finger-type glove body 1 is shown in the present example, but a mitten type (two or three finger-type) glove body 1 can also be used.

The present example shows a case in which the access opening 4 is provided to the exterior surface of the hem part 10 of the glove body 1. However, the access opening 4 may also be provided to the hem line 10A or the inner surface of the hem part 10 of the glove body 1.

The covering body 3 in the present example has a three finger-type mitten shape in which the index finger is separated. However, the covering body may also have a normal two finger-type mitten shape, or a five finger-type shape instead of a mitten shape.

The covering body 3 may be endowed with a goggle blade function for removing fog or water droplets from goggles or eyeglasses, a waterproofing function, a water-repelling function, a gripping function using a material that imparts the palm portion with excellent grip, or an enhanced cold-weather protection function provided by using an insulating material.

The auxiliary closing/opening part 6 may have a different opening shape, and may have a different opening/closing structure.

What is claimed is:

1. A cold-weather glove comprising:

a glove body including fingertips and a hem part on a wrist portion of the glove body distant from the fingertips;

a back-of-the-hand portion provided on a back of the glove body;

an accommodation part provided within the back-of-the-hand portion of the glove body;

a covering body that is configured to cover a substantial portion of the glove body from the fingertips to the hem part, the covering body is configured to be accommodated and disposed inside the accommodation part;

an access opening that is capable of being opened and closed is provided on the hem part in the back-of-the-hand portion of the glove body, the access opening having an opening width in a peripheral direction along the hem part, and connecting an outer part of the hem part to an inner part of the accommodation part;

wherein the covering body is configured to be withdrawn from or inserted into the accommodation part via the access opening; and the covering body is connected to the hem part of the glove body or the accommodation part;

wherein the hem part of the glove body includes a laterally extending part that is configured to extend around a circumference of the wrist portion;

wherein a releasable holding means is provided for holding the laterally extending part along a palm part-side of the glove body; and wherein the access opening extends to the laterally extending part.

2. The cold weather glove according to claim 1, wherein the laterally extending part has a band shape and extends in the band shape laterally with regard to the glove body; and when the laterally extending part is superposed in alignment along a palm part-side of the hem part, the access opening is extended to an area that is on the palm part side.

3. The cold-weather glove according to claim 1 or 2, wherein the access opening is configured so as to be capable of being opened and closed via a fastener.

4. The cold-weather glove according to claim 1 or 2, wherein the access opening is provided to a surface of the hem part in the back-of-the-hand portion of the glove body;

the access opening extends to a surface of the laterally extending part; and a fastener is provided to the access opening, wherein the fastener can be opened and closed by moving an operating part.

5. The cold-weather glove according to claim 3, wherein the access opening is provided on a surface of the hem part in the back-of-the-hand portion of the glove body;

the access opening extends to a surface of the laterally extending part; and a fastener is provided to the access opening, wherein the fastener can be opened and closed by moving an operating part.

6. A cold-weather glove comprising:

a glove body including fingertips and a hem part on a wrist portion of the glove body distant from the fingertips;

a back-of-the-hand portion provided on a back of the glove body;

an accommodation part provided on the back-of-the-hand portion of the glove body;

a covering body that is configured to cover a substantial portion of the glove body from the fingertips to the hem part, the covering body is configured to be accommodated and disposed inside the accommodation part;

an access opening that is capable of being opened and closed is provided on the hem part in the back-of-the-hand portion of the glove body, the access opening having an opening width in a peripheral direction along the hem part, and connecting an outer part of the hem part to an inner part of the accommodation part;

wherein the covering body is configured to be withdrawn from or inserted into the accommodation part via the access opening; and the covering body is connected to the hem part of the glove body or the accommodation part;

wherein the hem part of the glove body includes a laterally extending part that is configured to extend around a circumference of the wrist portion;

wherein a fastener is provided to hold the laterally extending part along a palm part-side of the glove body; and wherein the access opening extends to the laterally extending part.

7. The cold weather glove according to claim 6, wherein the laterally extending part has a band shape and extends in the band shape laterally with regard to the glove body; and when the laterally extending part is superposed in alignment along a palm part-side of the hem part, the access opening is extended to an area that is on the palm part side.

8. The cold-weather glove according to claim 6, wherein the access opening is configured so as to be capable of being opened and closed via an access opening fastener.

9. The cold-weather glove according to claim 6, wherein the access opening is provided to a surface of the hem part in the back-of-the-hand portion of the glove body;

the access opening extends to a surface of the laterally extending part; and an access opening fastener is provided to the access opening, wherein the access opening fastener can be opened and closed by moving an operating part.

10. The cold-weather glove according to claim 8, wherein the access opening is provided on a surface of the hem part in the back-of-the-hand portion of the glove body;

the access opening extends to a surface of the laterally extending part; and an access opening fastener is provided to the access opening, wherein the access opening fastener can be opened and closed by moving an operating part.

* * * * *